US006516900B1

(12) United States Patent
Tokle

(10) Patent No.: US 6,516,900 B1
(45) Date of Patent: Feb. 11, 2003

(54) APPARATUS FOR DIRECTIONAL DRILLING

(75) Inventor: Victor Tokle, Trondheim (NO)

(73) Assignee: Devico AS, Melhus (NO)

( * ) Notice: Subject to any disclaimer, the term of this patent is extended or adjusted under 35 U.S.C. 154(b) by 0 days.

(21) Appl. No.: 09/857,834

(22) PCT Filed: Dec. 7, 1999

(86) PCT No.: PCT/NO99/00367

§ 371 (c)(1),
(2), (4) Date: Jun. 8, 2001

(87) PCT Pub. No.: WO00/34616

PCT Pub. Date: Jun. 15, 2000

(30) Foreign Application Priority Data

Dec. 9, 1998 (NO) ..... 985756

(51) Int. Cl.[7] ..... E21B 7/06

(52) U.S. Cl. ..... 175/73; 175/76; 175/325.1; 166/241.1

(58) Field of Search ..... 175/73–76, 61, 175/325.1; 166/241.1

(56) References Cited

U.S. PATENT DOCUMENTS

| | | | | |
|---|---|---|---|---|
| 4,770,258 A | 9/1988 | Falgout | ..... | 175/73 |
| 5,220,963 A | 6/1993 | Patton | ..... | 175/24 |
| 5,421,421 A | 6/1995 | Appleton | ..... | 175/76 |
| 6,349,780 B1 * | 2/2002 | Beuershausen | | |
| 6,419,014 B1 * | 7/2002 | Meek et al. | | |

FOREIGN PATENT DOCUMENTS

| | | | | |
|---|---|---|---|---|
| DE | 26 09 996 A1 | 3/1976 | ..... | E21B/7/12 |
| EP | 0 015 137 | 2/1980 | ..... | E21B/7/06 |
| NO | 168962 | 3/1987 | ..... | E21B/7/04 |
| SE | 508 950 | 11/1998 | ..... | E21B/17/10 |

* cited by examiner

*Primary Examiner*—Roger Schoeppel
(74) *Attorney, Agent, or Firm*—Crompton, Seager & Tufte LLC

(57) ABSTRACT

Grip and guiding device for directional drilling, in order to drill straight or curved holes with a predetermined path. The device includes a drill string (11–21) comprising parts which rotate during drilling, including a drill bit (11) or a water hammer on its front end and a non-rotating packer unit (14) with a packer tubing (28) comprising one or several projecting pressure pads (25,31–32) arranged behind the drill bit (11) or the water hammer. The pressure pad or pads are arranged to be pressed out towards the drill hole wall by means of the pressure from a drill fluid when this exceeds a certain level. The pressure pad (25) or the pressure pads (25A–25C) may be arranged asymmetrically and/or affects the packer tubing (28) asymmetrically, e.g. by having different heights. The pressure pad(s) force guiding ribs on the opposite side into the hole wall in order to prevent rotation of the packer unit (14). The pressure pad or pressure pads can on deactivation be withdrawn for performing linear drilling.

10 Claims, 3 Drawing Sheets

APPARATUS FOR DIRECTIONAL DRILLING

The invention relates to a grip and guiding device for a directional drill for geotechnical drilling, especially rock drilling, more precisely a device as defined by the introductory part of claim 1, particularly for directional drilling with high precision in sedimentary species of rock.

BACKGROUND

A directional drill is described in NO C 168 962 which is provided with a locking device or packer which is supplied with drilling fluid under pressure in order to push out locking elements or pressure pads which can be brought in contact with the bore wall and lock the directional drill relative to the wall, so that rotation of the outer tubing of the directional drill is avoided. Such pressure pads may be utilised for locking an eccentric housing in a certain position or be used to bring upon the drill bit a skewed position, for thereby performing directional drilling.

From NO patent application Ser. No. 962744 is known a guidance tool for a rock drill where several pressure pads are arranged in at least two ring sections, so that the pressure pads become oriented in axial rows with projecting guiding bars oriented in a row. This solution is intended to reduce; the frictional forces, which are effective in the axial direction when the drill is moved forward and shall at the same time ensure a frictional force against rotation sufficient to avoid a rotational movement. The guidance is in this case ensured by a permanent eccentric housing positioned between the packer and the drill bit, known from the patent publication mentioned above.

A significant disadvantage with this known solution is that it requires several sets of pressure pads in rows in the length direction of the tool. The known rock drill requires the packer in the drill hole to be positioned centrically.

Directional drills are also known with several sensor controlled pressure pads arranged symmetrically around the periphery in order to provide a so-called "modulated pre-tensional force". By activating the pressure pads independently is it possible to obtain a deviated position of the drill bit in relation to the main axis, and thus guide the drilling to obtain a directional drilling, i.e. drilling in a predetermined curved path. This solution, however, requires a complicated sensor system and a correspondingly complicated guidance mechanism, for the supply of pressure media to the several pressure pads. It is therefore costly and unreliable.

OBJECTIVE

It is thus a main objective with the present invention to provide a directional drill with a grip and guidance system which is simpler than the known grip and guidance systems, and which provides a higher directional stability and higher versatility when used.

It is a particular objective to provide a directional drill which can be guided and repositioned with simpler means than the known directional drills. It is preferred to make use of a versatile directional drill, which can be used, in hard rocks as well as in sedimentary species of rocks. It is preferred to be able to drill both with a core tubing with an eccentric housing and alternatively with the deviation provider in the packer area, i.e. with an active eccenter.

It is a further objective to provide a directional drill with a grip and guidance system which can be used with a water hammer or another kind of drill hammer or drilling tool.

Further objectives of the invention will be disclosed by the more detailed description below.

THE INVENTION

The invention is defined by claim 1. Preferred embodiments of the invention are defined by the dependent claims 2–10.

The directional drill according to the invention is significantly simpler, and thereby more sturdy in use, than those previously known. This also gives the possibility to ensure a stable directional drilling by means of simple adjustment steps. Further details of the invention are disclosed by the example below.

EXAMPLE

In the following the invention is described in more detail with reference to the accompanying drawings, where FIG. 1 is a side view of a section of a directional drill according to the invention, FIGS. 2*a* and 2*b* are sections of an embodiment of the invention, showing the design and position of a pressure pad and guidance ribs, with the pressure pad in an extended and retracted position respectively.

FIG. 3 shows a section of FIGS. 2*a* and 2*b* in a larger scale, illustrating how the guidance ribs are built-in.

Figure 1:
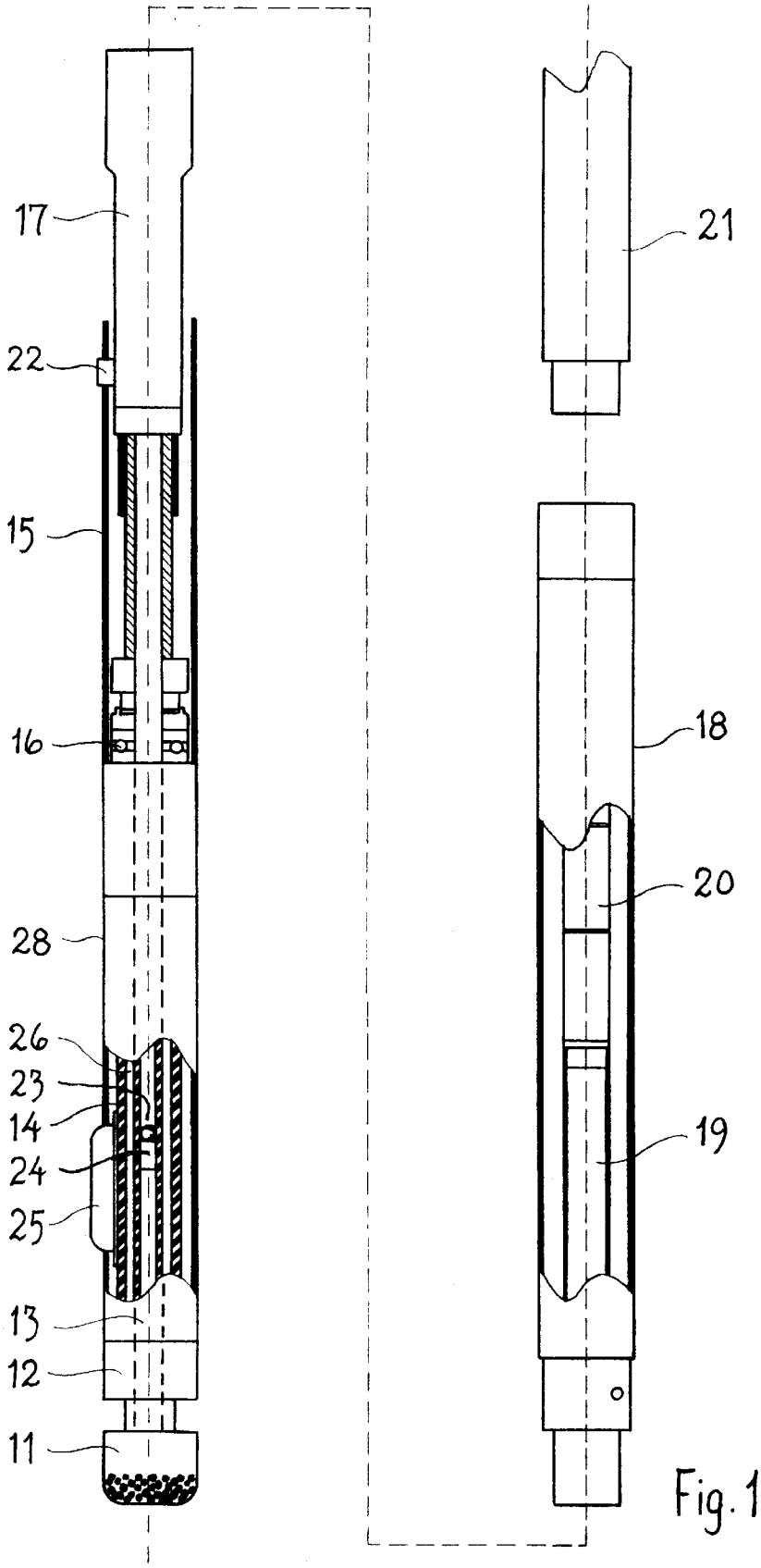

In FIG. 1 a directional drill is illustrated with a leading drill bit 11, which is connected to a drive shaft 13. A bearing housing 12, a packer unit 14 and a packer tubing 28, the back end of which is connected to an outer tubing 15, surrounds the front end of the drive shaft 13.

The drive shaft 13, which is tubular, is connected to a combined locking and connecting unit 17 behind the thrust bearing 16. The combined locking and connecting unit 17 is enabled by means of a pressure valve and an orientational unit 18 connected to an electronic circuit 19 for providing information up to the surface regarding its rotational angle and deviation. The orientational unit 18 also holds a battery 20. The orientational unit 18 is attached to a tube shaped drill string 21. Both the locking and connecting unit 17 and the orientational unit 18 are tube shaped and provide access for drill fluid to flow therethrough under pressure.

The locking and connecting unit 17 is equipped with a locking piston 22. An internal spring member that provides a pressure P0 presses out the locking piston 22 into an active position. At a water pressure P1 the spring is compressed into a passive position. In order to reorient the drill, the pressure P1 is lowered to a level P0, so that the spring member pushes the locking piston out. The pressure will still be high enough to expand the packer and prevent the outer tubing from rotating. By slow rotation the locking piston 22 will enter a grove in the locking tube (the outer tubing 15). The sensors in the orientational unit will activate this by holding the equipment steady for a period of time whereafter a new reorientation may be performed.

The drive shaft 13 and the packer 14 are equipped with a controlling valve 23 and a draining valve 24 to be further described with reference to FIG. 6. The packer unit 14 has in this example a pressure pad 25 projecting out from an opening in the packer tubing 28, the pressure pad being influenced by a packer 26 in the form of a tube shaped rubber expander as known from NO patent No. 168 962.

Figure 2A:
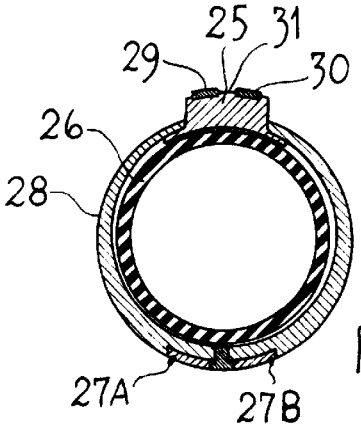
Figure 2B:
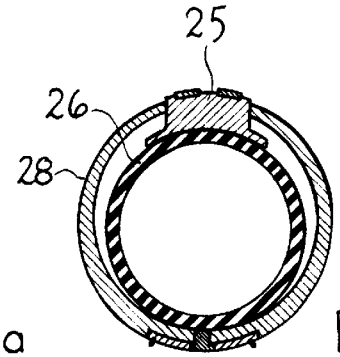

A preferred embodiment of the pressure pad 25 is shown in FIGS. 2*a* and 2*b*. Here a single pressure pad 25 is used on one side of the packer unit 14. Symmetrically to the pressure pad 25 are arranged two longitudinally oriented hard metal ribs 27A, 27B on the packer tubing 28. The ribs 27A, 27B will on activation of the packer unit 14 cut into the hole wall and prevent rotation. The configuration and position of the ribs 27A, 27B are shown in more detail in FIG. 3. The pressure pad further includes two hard metal reinforcement areas 29, 30, arranged side by side in recessed grooves in the pressure pad end, so that a groove 31 is formed there between. In sedimentary species of rock this pressure pad will steer like a ski.

The pressure pad 25 can as an alternative to the hard metal reinforcement areas, comprise one or more longitudinally extending V-shaped ribs or edges to cut a groove in the hole wall and ensure a better guidance in hard rock. The size and shape of the ribs may vary dependent on the deviated material, but it will typically be V-shaped.

FIG. 2*a* shows the pressure pad in a projected position while in FIG. 2*b* it is retracted.

An alternative (not illustrated) embodiment comprises two pressure pads and an oppositely, symmetrically arranged guidance rib. This solution is preferred for drilling in loose rock formations. This arrangement will give a wider extension range for the pressure pads and higher specific pressure.

A rubber packer 26 of a known design supports the pressure pad 25 internally. The pressure pad is extended and according to the example has a length 3 times its width. The dimensions are adapted to the formations in which the directional drill is to be used, and may thereby deviate from the dimensions shown. It has rounded ends to reduce the friction when moved in a forward direction.

Figure 3:
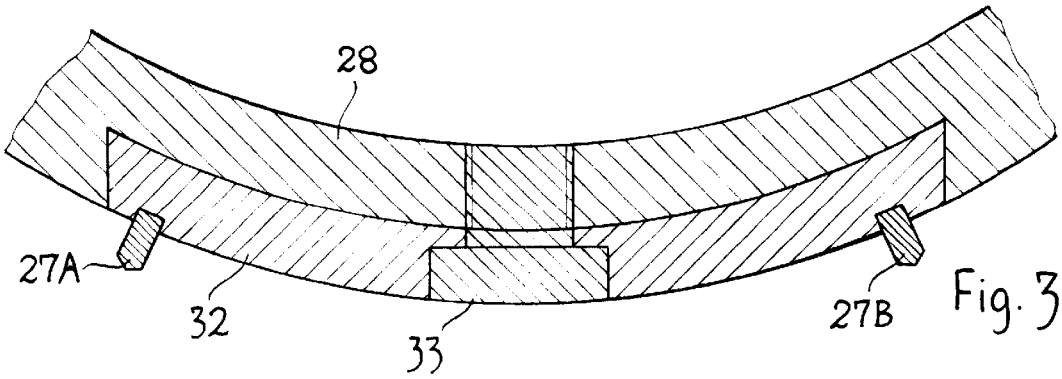

In FIG. 3 is shown a section, of FIGS. 2*a* and 2*b* in a larger scale; depicting the recessed attachment of the guidance ribs 27A, 27B. They are attached partly recessed in longitudinally shaped groove. Is in a curved supporting plate 32 which is fitted into a recess in the packer tubing 28 and secured to this with one or several screws 33. The large area of the supporting plate prevents it from penetrating deep into the mass. The advantage of this solution is that the hard metal ribs may easily be replaced for adjustment of deviation angel or for wear or breakage, without disassembling the entire directional drill.

Figure 4A:
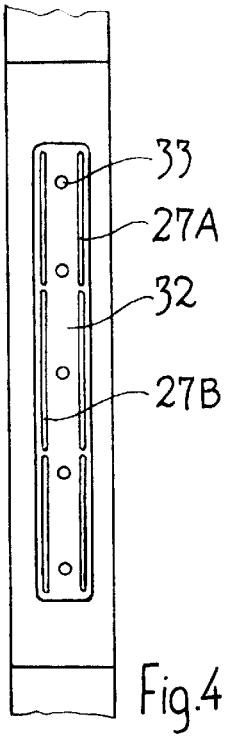
FIGS. 4*a–c* show different side views, partly sectioned, of a part of a packer tube with three pressure pads.
Figure 4B:
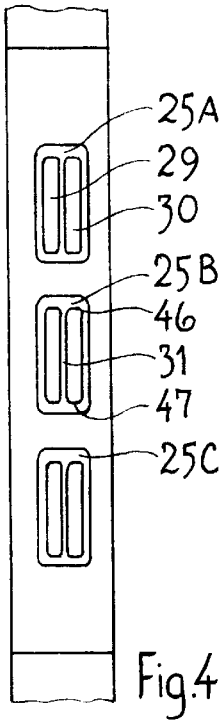
Figure 4C:
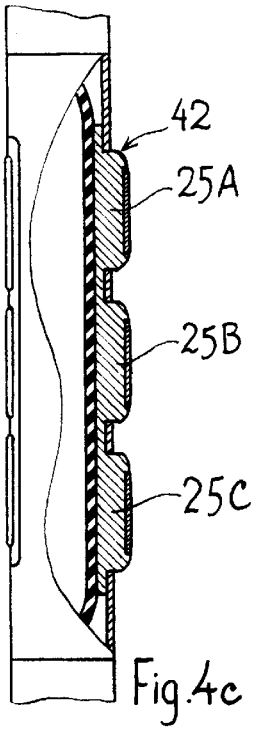

In FIGS. 4*a–c* views are shown from three sides of a pressure element 42 with three pressure pads 25A–25C and an oppositely arranged supporting plate 32 with five attachment screws 33 and two hard metal ribs 27A, 27B.

Figure 5:
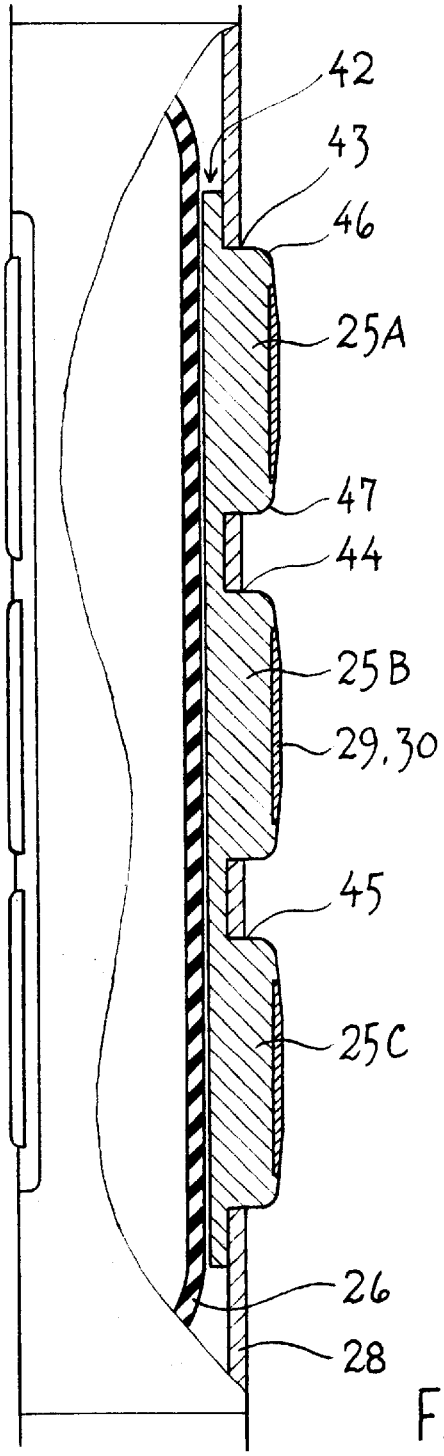
FIG. 5 shows an enlarged section of FIG. 4*c,*.

FIG. 5 shows an enlarged section depicting the pressure pads 25A–25C and their arrangement. The pressure pads 25A–25C project from the packer tubing 28 through corresponding openings 43–45.

The pressure pads are rounded at edges 46 and 47 to reduce frictional forces when moved forward. In this case each pressure pad 25A–25C is provided with respective pairs of hard metal reinforcements 29, 30 (like in FIGS. 2*a*, 2*b*) arranged side by side in the pressure pad, between which a guidance groove 31 is thereby formed like the groove under a ski. The hard metal reinforcement may be glued or soldered to the pad.

Figure 6:
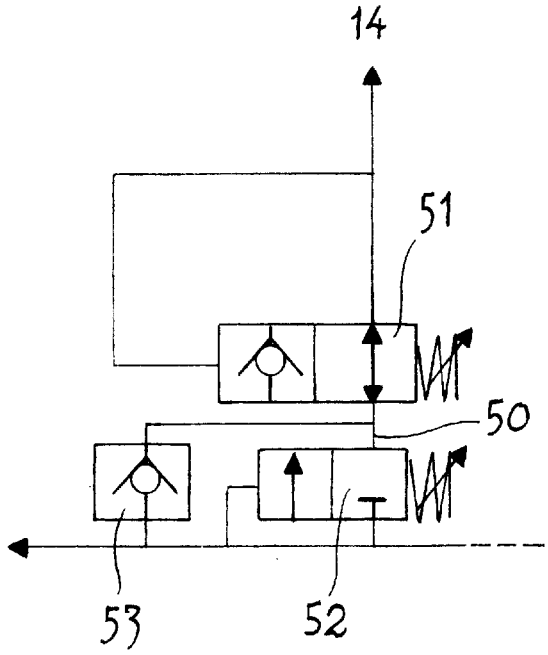
FIG. 6 shows a block diagram for a guidance system for selective activation of the packer-unit.

FIG. 6 shows a block diagram of an example of a valve arrangement to control the packer unit 14. In the drive shaft 13 is arranged a filter (not shown) from which a conduit 50 leads to a first controlling valve 51 in order to control the pressure in the packer 14. With a pressure P3 the control valve 51 will close so that the packer is activated.

The control valve 51 may be a standard valve which is adapted to water hydraulic systems for automatic closure when the pressure exceeds an adjustable and predetermined level. When the pressure in the drill string is reduced below the selected level, the valve is opened and the packer deactivated.

It is possible to combine this solution with an extra valve 52 which ensures that the packer does not expand before the pressure in the drill string has reach a certain level. The valve 52 is placed in the conduit to the controlling valve 51 and opens at a lower pressure than this. Between the packer 14 and the drill string there may be arranged a non-return valve 53 in order to drain the packer when the pressure in the drill string is reduced.

Method of Use

After pre-drilling a hole with conventional equipment, the drilling unit is entered into the hole. The locking piston 22 is locked to the outer tubing 15 during entry so that the packer unit 14 and the drive shaft 13 are attached to one another. This ensures that the orientation of the directional drill, i.e. The toolface angle (rotational position) of the packer 14 and the pressure pads are known and provides the basis for determining the further development of the drill hole.

The activation pressure for the locking piston 22 and the packer 14 can be adjusted so that the locking piston 22 is withdrawn when the pressure exceeds a certain level P1. The drive shaft is thereby released from the outer tubing. It is then possible to perform a full profile drilling or a core drilling. The guidance ribs will steer the packer and prevent rotation. As soon as the packer unit has turned more than a certain angle, allowing the locking piston 22 to engage and activate the orientational unit, it will thereby initiate a reorientation of the packer unit.

When the pressure of the drilling fluid is increased (controlled from the surface) to a level over the activation level for the controlling valve 23, which is a higher pressure level P3, the packer becomes deactivated. Thereby the pressure pads 25 will not induce an asymmetrical positioning of the directional drill, and straight drilling can be performed. This will in this case replace directional drilling controlled by an eccentric housing. The outlet valve 51 has a constant drainage so that the packer pressure disappears when the controlling valve 23 is deactivated.

The invention may also be utilised together with a water hammer arranged at the front end of the packer unit, with an intermediate damper. The damper will prevent vibrations from the hammer to influence the packer to turn clockwise. In addition it will reduce the strain on the sensor elements in the orientational unit.

In order to activate such a hammer the pressure P must be increased so that the valve opens fully.

The device may comprise two or, more packer units in series, where the first one is adapted to be activated to a certain eccentricity at a first pressure level, while the second and subsequent are activated to a stepwise increasing eccentricity at higher pressure levels in the drill string. Several packer units in series will increase the contacting area when drilling in sedimentary species of rock.

The invention may also be utilised for packers where the pressure pads are activated by means of two sets of jointed arms led between two central sliding casings, either by use of asymmetrical jointed arms or by use of asymmetrical pressure pads.

In an alternative embodiment, asymmetrical locking of the drill string may be obtained by utilising evenly distributed pressure pads with different projections. One high and one low pressure pad may be used for example, or two low and one high. A corresponding effect may be obtained by limiting the projections to one or some pressure pads by means of adjustable stop screws.

What is claimed is:

1. Grip and guiding device for directional drilling, especially for directional drilling with high precision in the guidance of direction in order to drill straight or curved holes with predetermined paths, including a drill string (11–21) comprising parts which rotate during drilling, comprising a drill bit (11) or a water hammer on its front end and a packer unit (14) with a packer tubing (28) comprising at least one pressure pad (25, 25A–25C) arranged asymmetrically behind the drill bit (11), wherein the at least one pressure pad are arranged to be pressed out towards the drill hole wall by means of the pressure from a drill fluid when this exceeds a certain level (P3), and at least one pressure pad (25); (25A–25C) is provided with an inner collared rim, and is exposing an extended face to a tubular packer (26), the rim restricting the outward movement of the at least one pad in the tubing (28).

2. Device according to claim 1, including at least one longitudinally extending guiding rib (27A, 27B) is provided to the opposite side in relation to the at least one pressure pad.

3. Device according to claim 2, including a pressure pad (25) and two guiding ribs (27A, 27B) or two pressure pads and one guiding rib are arranged on a replaceable support.

4. Device according to claim 2, wherein the eccentricity of the packer an be adjusted by changing the projection of the support for the guiding ribs.

5. Device according to claim 1, wherein the pressure pad is extended and comprise(s) several pressure pads in a row arranged on a common support.

6. Device for directional drilling according to claim 1, wherein the at least one pressure pad has an evenly curved surface in the crosswise direction, with a radius dimensioned between the outer positions and are rounded off on each edge.

7. Device for directional drilling according to claim 1, wherein the locking and connecting unit (17) in a certain angular position in relation to the at least one pressure pad has a radial locking piston (22) which is influenced by the drill fluid so that it is retracted during drilling and sufficiently high hydraulic pressure, whereas reduced drill fluid pressure will allow the piston (22) to be pressed out by a spring member or the like to a locking engagement with the outer tubing (15) which is connected to the packer tubing (28).

8. Device according to claim 1, including a pressure valve which closes for inflow of drill fluid to the packer when the pressure of the drill fluid exceeds a certain level and the packer is provided with an outlet valve with reduced opening for draining of the pressure in the packer to the drill string or the annular room in the packer.

9. Device according to claim 1, wherein the asymmetry may be obtained by allowing one or more of the pressure pads to have a height different from the other ones.

10. Device according to claim 9, wherein the packer unit has symmetrically distributed pressure pads with asymmetrical projections, especially by means of adjustable stop screws or the use of pressure pads with different heights.

* * * * *